US007301085B2

(12) United States Patent
Wyman

(10) Patent No.: US 7,301,085 B2
(45) Date of Patent: Nov. 27, 2007

(54) STRINGED MUSICAL INSTRUMENT HAVING HARMONIC BRIDGE

(76) Inventor: Kevin Alexander Wyman, 2246 N. 74th Way, Scottsdale, AZ (US) 85257

( * ) Notice: Subject to any disclaimer, the term of this patent is extended or adjusted under 35 U.S.C. 154(b) by 0 days.

(21) Appl. No.: 11/317,728

(22) Filed: Dec. 23, 2005

(65) Prior Publication Data

US 2007/0144327 A1 Jun. 28, 2007

(51) Int. Cl.
*G10D 3/00* (2006.01)
*G10D 3/04* (2006.01)

(52) U.S. Cl. ..... 84/291; 84/294; 84/275; 84/298; 84/307

(58) Field of Classification Search ..... 84/291, 84/295, 275, 294, 298, 307
See application file for complete search history.

(56) References Cited

U.S. PATENT DOCUMENTS

| | | | | | |
|---|---|---|---|---|---|
| 375,224 | A * | 12/1887 | Talbott | 84/291 |
| 465,490 | A * | 12/1891 | Olson | 84/295 |
| 1,183,369 | A * | 5/1916 | Gardie | 84/263 |
| 1,489,710 | A * | 4/1924 | Olsen | 84/295 |
| 1,653,570 | A * | 12/1927 | Howe | 84/173 |
| 1,762,408 | A * | 6/1930 | Nelson | 84/291 |
| 3,969,971 | A * | 7/1976 | Delu | 84/274 |
| 3,974,730 | A | 8/1976 | Adams, Jr. | |
| 4,172,404 | A * | 10/1979 | Dopyera | 84/291 |
| 4,282,792 | A * | 8/1981 | Voorthuyzen | 84/295 |
| 4,332,184 | A * | 6/1982 | Phillips | 84/173 |
| 6,376,755 | B1 * | 4/2002 | Kammerer | 84/290 |
| 6,943,283 | B2 | 9/2005 | McPherson | |
| 7,166,788 | B2 * | 1/2007 | Wyman | 84/291 |
| 2007/0125221 | A1 * | 6/2007 | Olson | 84/294 |
| 2007/0144327 | A1 * | 6/2007 | Wyman | 84/267 |

OTHER PUBLICATIONS

The Classical Guitar Book, Jan. 8, 2005 (date retrieved from the Internet), 3 pages, (Retrieved from the Internet <URL: http://www.morrish.dircon.co.uk/classical.html).

Fletcher, Neville H. and Rossing, Thomas D., *The Physics of Musical Instruments*, 2nd ed., Springer-Verlag, New York, 1998, Chap. 9, "Guitars and Lutes", pp. 239-270.

Gough, Colin, "Science and the Stradivarius", *Physics World*, Apr. 2000, 9 pages.

(Continued)

*Primary Examiner*—Lincoln Donovan
*Assistant Examiner*—Robert W. Horn
(74) *Attorney, Agent, or Firm*—Cyr & Associates, P.A.

(57) ABSTRACT

A stringed musical instrument is provided with a plate or soundboard that is curved to define a crest parallel to the strings. If the instrument is a closedbox instrument, another plate opposing the first plate may be curved to define a crest perpendicular to the strings. The first plate may be supported by transverse braces, which are scalloped to leave substantial air gaps along the glue line once the brace is attached. The back plate may be supported by a substantial longitudinal brace or spine, which runs down its center parallel to the strings. The spine contains a substantial portion of the mass of the back plate. These musical instruments have reduced wolf tones and improved harmonic generation over common instruments, and therefore have a more complex and pleasing tone than common instruments. The harmonic character of these instruments is fully exploited by using one or more harmonic bridges in addition to the primary bridge.

20 Claims, 13 Drawing Sheets

OTHER PUBLICATIONS

Guild® Gear / Acoustics / GAD-JF30, Jan. 8, 2005 (date retrieved from the Internet), 2 pages, (Retrieved from the Internet <URL http://www.guildguitars.com/gear/gear.php?partno=3813000).

Polettipiano, Reproducing the Sounds of Ancient Instruments, Jan. 8, 2005 (date retrieved from the Internet), 5 pages, (Retrieved from the Internet <URL: http://www.polettipiano.com/Pages/air_modes.html).

Fernandezmusic, The Traditional Spanish Method of Classical Guitar Construction, Jan. 8, 2005 (date retrieved from the Internet), 4 pages, (Retrieved from the Internet <URL: http://www.fernandezmusic.com/Trad.%20Spanish%20Method.html).

U.S. Appl. No. 11/034,167, for Kevin Alexander Wyman entitled "Stringed Musical Instrument", filed Jan. 12, 2005.

* cited by examiner

STRINGED MUSICAL INSTRUMENT HAVING HARMONIC BRIDGE

BACKGROUND OF THE INVENTION

1. Field of the Invention

The present invention is directed to stringed musical instruments, and more particularly to stringed musical instruments with improved harmonic generation.

2. Description of the Related Art

An important characteristic of a musical instrument is its tone. A tone may be considered as a particular combination of a fundamental frequency and accompanying harmonics, each with a particular amplitude and phase. The combination of these harmonics gives an instrument its tone. For instance, an "A" note played on a violin will sound different from an "A" note played on a guitar, even though both "A" notes have a fundamental frequency of 440 Hz, because a violin has a different characteristic tone from a guitar. Likewise, a pure sine wave at 440 Hz, which has no accompanying harmonics, will sound different from an "A" played on either a violin or a guitar. Put simply, it is the harmonics accompanying each note that give an instrument its characteristic sound, or tone. In general, the more harmonics that accompany each note, the more complex the tone of the instrument, and the more pleasing the sound that is perceived by the listener.

The delicate purity of tone of the lute, viol and harp instruments found its zenith in quality in the twelfth and thirteenth centuries. The proportions of wood density and thickness of these instruments were of a much thinner and more responsive design than the later carved instruments. As venues graduated in size from the king's court and music rooms to theaters and concert halls, these designs evolved so as to accommodate higher string tension and acoustic cavity expansion, thereby producing a more powerful sound. Though these instruments seemed to perform well in the larger venues, the spectrum of tone and sustain was inhibited and shortened in proportion. In answer to this, the modern carved instrument evolved and was accepted, as it was found to recoup those lost qualities. Though drastically falling short of their predecessors, they none the less could be heard in the cheap seats. With very little change, these inadequacies are still present today.

Many of the stringed instruments, both antiquated and current, have several elements in common. The strings are fastened on the top side of the instrument, and generally extend along a neck. The tension of each string is adjustable at one or both ends, so that the instrument may be tuned. The strings acoustically couple to a soundboard through a bridge. In a closedbox instrument such as a guitar or violin, the soundboard or playing table may be domed or arched in places with respect to a coplanar edge, and may optionally have one or more holes in it that allow air to pass into and out of the instrument.

Another characteristic common to typical stringed instruments is that they inherently tend to produce too much energy in some harmonics, a condition which produces a type of dissonance known as "wolf tones." Wolf tone arise from imperfections in the construction of musical instruments that cause unpleasant intonation. These imperfections tend to produce an eccentricity of resonance that is slightly sharp or slightly flat in relation to the principal note, which either enhances or damps the principal note to produce a characteristic fluttering or wailing sound. Wolf tones occur on many of the stringed instruments, but are most prevalent on the violin, viola, and violoncello.

Stringed instruments are corrected for wolf tones in various ways, both in the finished instrument as well as in the design of the instrument. Devices known as "wolf mutes" are available for finished instruments. One type of wolf mute mounts on the string between the bridge and the anchor. Another type is glued to the inside surface of the playing table. However, wolf mutes affect characteristics of the instrument, including loudness and timbre. In the design of the violin, the string length, bridge, tail piece, and saddle can all be adjusted to compensate for the inherent inharmonics so that the wolf tones are suppressed. In the guitar, the notes as determined by the placement of the frets, and example of which is set forth below in Table 1, is inharmonic to help suppress wolf tones. Note, for example, that the first harmonic of A 440 hertz is an inharmonic 847.3099 hertz, not the proper harmonic of 880 hertz.

TABLE 1

| | | | | | |
|---|---|---|---|---|---|
| A | 440 | | | | |
| $B^b$ | 464.69551 | D | 578.13821 | $F^\#$ | 719.27485 |
| B | 490.77708 | $D^\#$ | 610.58688 | G | 759.64499 |
| C | 518.32251 | E | 644.85678 | $G^\#$ | 802.28095 |
| $C^\#$ | 547.41396 | F | 681.05012 | A | 847.30991 |

Unfortunately, the need to compensate for the inherent inharmonics of the stringed instrument compromises instrument performance.

BRIEF SUMMARY OF THE INVENTION

Accordingly, there exists a need for a stringed instrument that has an increased richness in tone, characterized by an increase in the complexity of harmonics that accompany each note. This and other advantages are achieved in whole or in part by the incorporation, in accordance with the present invention, of multiple bridges in stringed instruments.

Because of their unique design, one or more of the embodiments of the instruments using multiple bridges as described herein provides a much wider range of the tonal spectrum and a brighter, fuller timbre which greatly enhances its performance possibilities. One or more embodiments of the present invention include various innovations in components such as the rib, brace and/or block system, which corrects and supports total sustain and improves bow and pick response by equalizing tension in both directions of string vibration, and which eliminates counterproductive vibration such as wolf tones and inharmonic incidence to improve the free vibration of strings at multiple intonations.

Advantageously, one or more embodiments of the present invention provide increased tensile strength to various body surfaces, thereby providing increased responsiveness to higher or lower string tensions without the tonal decay of modern designs, which makes it possible to produce greater power and volume without loss of tonal spectrum.

One embodiment of the present invention is a stringed musical instrument comprising a body, first and second bridges, and a plurality of strings. The body comprises a soundboard having a generally cylindrical curvature with a crest being defined thereon. The first bridge is mounted to the soundboard across the crest of the soundboard, and the second bridge is harmonically spaced away from the first bridge and mounted to the soundboard across the crest of the soundboard. The strings extend across the first and second bridges between a first acoustic termination and a second acoustic termination.

Another embodiment of the present invention is a stringed musical instrument comprising an acoustic body, first and second bridges, and a plurality of strings. The acoustic body comprises a top plate having a curvature that defines a crest thereon, a back plate, and a rib coupling the top plate and the back plate to form an acoustic cavity. The first bridge is mounted to the top plate across the crest of the top plate, and the second bridge is harmonically spaced away from the first bridge and mounted to the top plate across the crest of the top plate. The strings extend across the first and second bridges between a first acoustic termination and a second acoustic termination.

Another embodiment of the present invention is a stringed musical instrument comprising an acoustic body, first and second bridges, a fingerboard, and a plurality of strings. The acoustic body comprises a top plate having a cylindrical curvature with a crest being defined thereon on an outside convex surface, a back plate having a cylindrical curvature with a crest being defined thereon, the crest of the top plate being perpendicular to the crest of the back plate, and a rib coupling the top plate and the back plate to form an acoustic cavity. The first bridge comprises a generally planar acoustic member mounted upon the outside convex surface of the top plate perpendicular to the crest of the soundboard. The second bridge is harmonically spaced away from the first bridge, and comprises a generally planar acoustic member mounted upon the outside convex surface of the top plate perpendicular to the crest of the soundboard. The strings extending across the fingerboard and the first and second bridges between a first acoustic termination near an end of the fingerboard distal of the acoustic body, and a second acoustic termination near an end of the acoustic body distal of the fingerboard. Segments of the strings extending between the first acoustic termination and the first bridge establish an instrument scale, segments of the strings extending between the first bridge and the second bridge establish a first harmonic scale; and segments of the strings extending between the second bridge and the second acoustic termination establish a second harmonic scale.

DETAILED DESCRIPTION OF THE INVENTION

Figure 1:
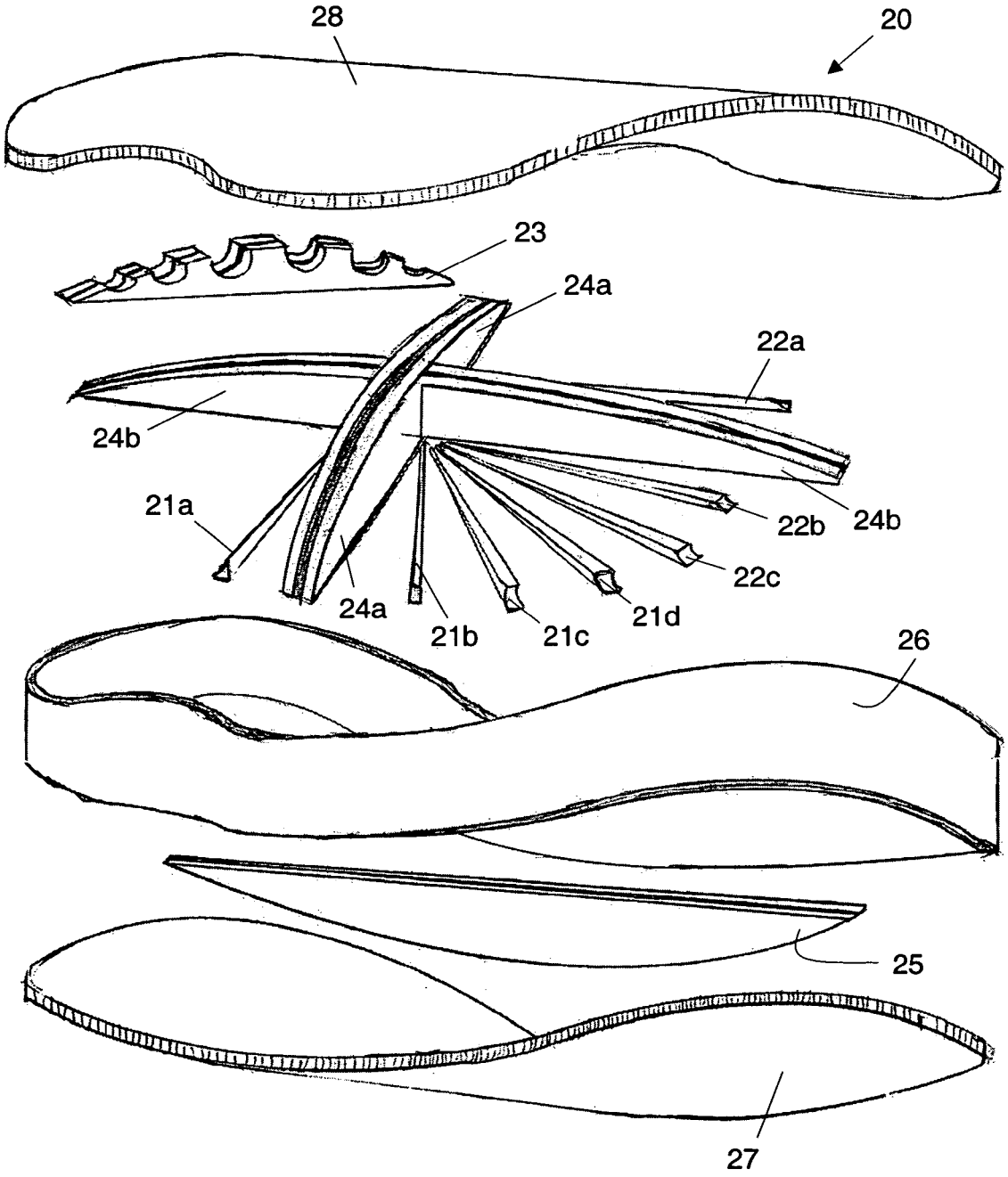
FIG. 1 is an exploded view of an acoustic guitar.

The sound produced by a musical instrument is highly dependent on the instrument's construction, including the choice of materials, the size, shape and placement of the components, and the way in which the components are attached. Some stringed instruments such as the modern piano rely on a soundboard for producing sound, and have no bottom, enclose no space, and therefore have no air resonance modes and can be considered to be acoustically transparent. Some stringed instruments such as guitars, lutes, violins, cellos, harps, and Viennese and South German pianos of the Classical period are closedbox musical instruments in which air resonances play a very active role in how acoustic energy flows through the entire system, causing subtle changes in the volume and sustain of the vibrations induced in the soundboard by the strings, and ultimately, the timbre radiated to the ears. These air resonances include many modes of resonance, all occurring simultaneously, and all filtering and shaping the final sound. All of these elements contribute to the overall sound of an instrument.

For instance, a particular wood may be used in a certain element of an instrument based on the wood's strength, density, tensile strength, and so forth. By altering a particular component, one may affect the overall tone of the instrument.

For instance, one may alter the back plate of a closedbox instrument by redistributing its mass, so that some locations on the plate have more mass, while other locations have less mass. Consider, for example, a back plate where a substantial fraction of its mass is concentrated along the longitudinal axis of the plate. Such a back plate may be made by using a thin sheet of material for the back plate itself, and attaching a strip of relatively dense material along the "spine" of the back plate (i.e., bisecting the back plate, parallel to the strings). If one wished to match the particular mass of the back plate of a known instrument, the back plate and spine may be designed so that the overall mass of the back plate remains essentially unaltered.

This modification of the back plate, with a substantial fraction of its mass located along its central axis, profoundly affects the performance of the instrument. For example, the "spine" of the instrument provides structural support for the instrument. In contrast with many common stringed instruments, in which a substantial amount of support between top and back plates is provided by one or more of the plates and by a rib that connects the plates along the perimeter of the instrument, an instrument with a substantial "spine" would get increased support from the spine itself, and would rely less on the rib and plates, typically the back plate, for structural support. With a substantial spine, the top and back plates would be less anchored at their edges (along the rib), and more anchored from the center (along the spine). This shift in structural duties away from the rib and a plate would leave the rib more free to vibrate along with the top and back plates, which tends to result in a louder instrument. Furthermore, because the rib itself is more free to vibrate, the sound produced by the instrument is more free to exit the instrument through the sides of the instrument, which tends to result in a more directionally uniform output for the instrument. In addition, placing a substantial portion of the mass of the back plate along its center tends to aid in the production of harmonics by the instrument symmetrically about the spine, which gives a more pleasing overall tone.

Figure 7:
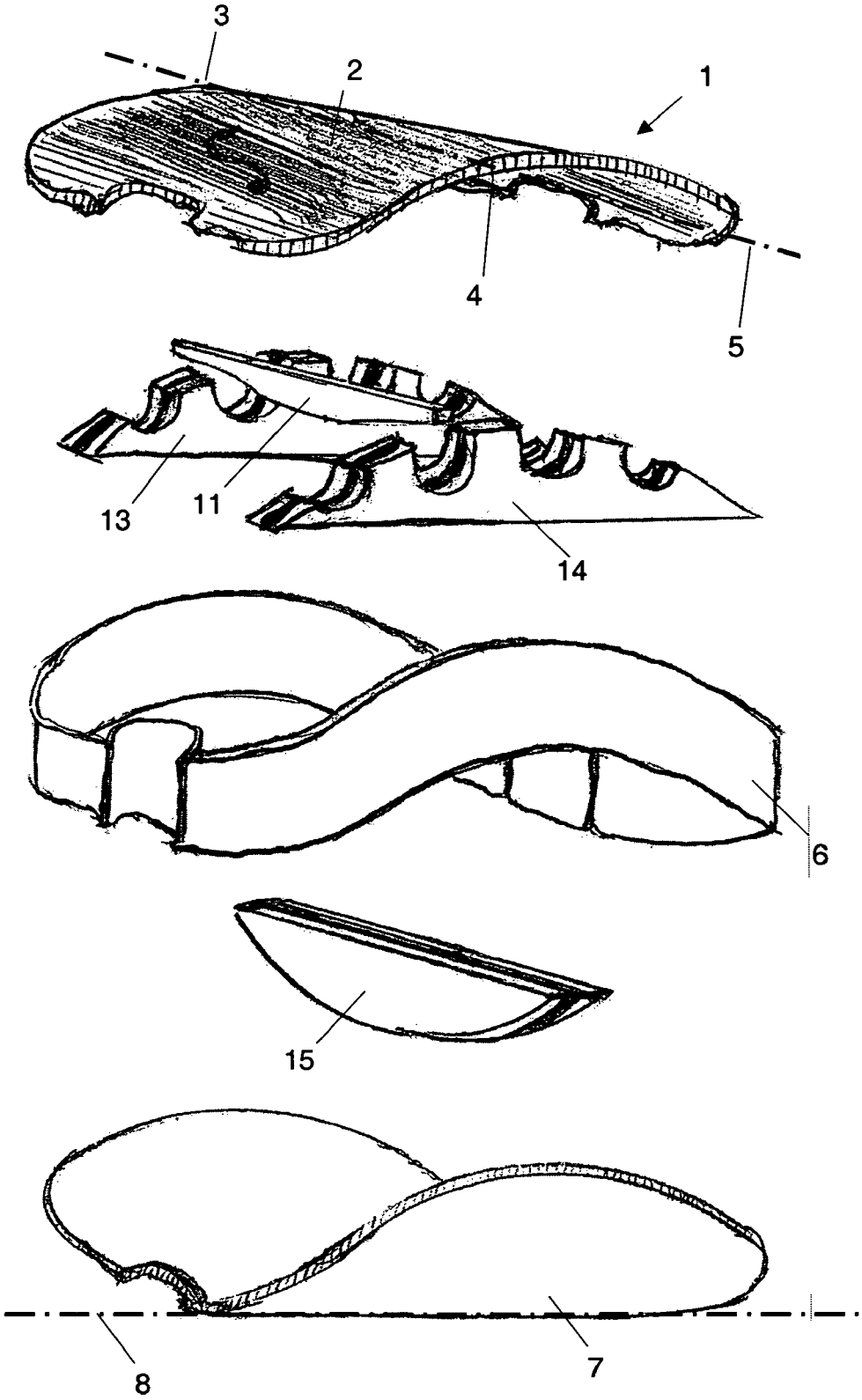
FIG. 7 is an exploded view drawing of a violin.

Another alteration to an instrument includes the addition of curvature to the soundboard or, in the case of a closedbox instrument, one or both of the top and back plates. Preferably, both the top and back plates are provided with curvature without constraining their edges to a plane. The top plate, for example, may have a generally cylindrical curvature, with a crest that is parallel to the longitudinal axis of the instrument, which is typically parallel to the strings. As an example, FIG. 7 shows a top plate 2 of a violin 1, which has a straight crest line 5 between the neck end 3 and lower end 4 of the top plate 2, parallel to the strings (not shown). The cylindrical curvature of the top plate may be oriented so that the farther away from the strings one goes, the closer to the back plate one gets; in other words, the "center" of the assembled instrument would be thicker than its "edges". This cylindrical curvature provides a focusing effect to the sound waves inside the instrument; sound energy that reflects off the cylindrically curved top plate is concentrated toward the center of the back plate, along its spine. The exact amount of concentration would depend on its radius of curvature and the distance to the back plate. Note that the curvature may be aspheric or conical in nature, but preferably is least curved along the longitudinal direction of the top plate.

Similarly, the back plate may have a generally cylindrical curvature as well, but preferably is oriented perpendicularly to the curvature of the top plate, so that points along the back plate near the center of the instrument are farther away from the front plate than points closer to or farther away from the neck of the instrument. FIG. 7 shows a back plate 7, with a straight crest line 8 oriented perpendicularly to the straight crest line 5 of the top plate 2. The cylindrical curvature of the back plate would also have a focusing effect on the sound waves inside the instrument, dependent on the radius of curvature. Similarly, the curvature may be aspherical or conical in nature, but preferably is least curved along the direction of the top plate normal to the longitudinal.

While cylindrical curvatures of the top and back plates are preferred, the curvatures may vary from cylindrical in any desired manner. In addition, the crest lines may alternatively be curved.

As a result of the orthogonal cylindrical curvatures of the top and back plates, the rib that connects the plates along their perimeters intersects the front and back plates over a substantial amount of the seams at angles other than 90°. This non-orthogonal intersection is desirable for the instrument, in that a non-90° seam is less rigid than a 90° seam, and allows the seam and the rib to flex more with the vibrations of the instrument. This tends to produce a louder output, and tends to allow more of the sound to escape from the sides of the instrument, desirably producing a more omnidirectional output for the instrument.

A further alteration to an instrument is the introduction of scalloped braces. Typically, braces are not scalloped where they contact a plate of an instrument. Consider the known use of braces on a top plate. Because a typical brace is continuous, it forms a boundary along the top plate, undesirably separating the top plate into two regions divided by the brace. By introducing scallops into the bracing used in places other than the longitudinal center of the back plate, the boundary between the two regions is reduced, and the tone of the instrument is enhanced. An example of a scalloped brace is shown in FIG. 1, where the upper transverse brace 23 is scalloped. Note that the curved side, which contains the scallops, is the side in contact with the top plate 28 of the instrument. The side opposite the scalloped side faces into the interior cavity of the instrument 20. Further examples of scalloped braces are the upper transverse brace 13 and lower transverse brace 14 shown in FIG. 7. The curved sides of these braces are in contract with the top plate 2, and the sides opposite the curved sides face into the interior cavity of the instrument.

In general, the techniques described above may be applied individually or in combination to a variety of stringed musical instruments, including guitars, violins, violas, cellos, mandolins, and others, including both closedbox and acoustically transparent instruments. The effect of the modifications is to increase the harmonics produced by the instrument, giving a more complex and more pleasing tone. In many cases, the overall volume of sound produced by the instrument is also increased. These amplified harmonics are generally radiated more uniformly from the instrument, with less directional dependence than typical instruments.

FIG. 1 shows an exploded view of a guitar 20. The strings, although not shown, would appear at the upper end of FIG. 1, and would be directly adjacent to the top plate 28, which is sometimes called a playing table. Attached to the underside of the top plate 28 is an upper transverse brace 23. The upper transverse brace 23 has a curved side with scallops, which supports the top plate 28 when the instrument is assembled. Opposite the scalloped side is a generally flat side, which faces into the acoustic cavity in the interior of the guitar. Also in contact with the underside of the top plate 28 is a cross brace 24, denoted by crossed elements 24*a* and 24*b*. The cross brace 24 also supports the shape of the top plate 28 when the instrument is assembled, and may also be called an X brace. In a radial pattern among the cross brace 24 are a series of treble tone bars 22*a-c* and bass tone bars 21*a-d*. The tone bars are also attached to the underside of the top plate 28, but are smaller than the cross brace 24 and play an acoustic, rather than a supportive, role in the guitar 20. Attached to the perimeter of the top plate 28 is a rib 26, which may also be referred to as a side. The rib 26 connects the top plate 28 and its attached elements 21-24 to the back plate 27 and a longitudinal brace 25 that is attached to the back plate 27.

The materials described below are discussed in the context of a guitar, but are generally applicable to any of the stringed instruments described herein. Note also that any of the instruments described herein may use any of the bracing schemes described herein, such as the X brace, or one or two transverse braces, or any other suitable bracing scheme.

The top plate 28 is preferably a sheet of spruce. Spruce is a preferred wood because it is generally light, and grows such that lines of its grain are exceptionally straight. As a result, it carries acoustic tones very well, and is an outstanding choice for the top plates of many stringed instruments. In general, the spruce is used so that its grain lines run from the top of the instrument (near the neck) to the bottom of the instrument (opposite the neck).

The upper transverse brace 23 is typically formed as a laminated wood structure. In the figures, a laminate is represented schematically by a "sandwich" construction, in which two light-colored woods surround a dark-colored wood core. In reality, the colors of the wood need not correspond to those of FIG. 1, and any suitable woods may be used. The preferred laminate structure for any of the stringed musical instruments described herein is a spruce exterior, flanking a core of ebony. Ebony is a very dense wood, and has excellent tensile strength. The presence of spruce on both sides of the ebony reduces the joint stress once the brace is glued in place. In addition, the presence of spruce in the laminate preserves the tonal quality of the instrument, since spruce is the preferred wood used for the top plate. The upper transverse brace 23 may be attached to the top plate 28 with an epoxy, glue, or other suitable bonding material. The upper transverse brace 23 has scallops, which leave substantial air gaps along the glue line when the brace is attached to the top plate 28. These air-filled scalloped regions may allow the top plate 28 to more easily deform along its longitudinal axis while generating resonant harmonic modes, thereby acting as acoustic viaducts allowing acoustic energy to access the outer regions of the surface of the top plate 28.

Similarly, the cross brace 24 is also a wood laminate, and is attached to the top plate 28 in a similar manner as the upper transverse brace 23. As discussed above, the preferred choice for the laminate is an ebony core surrounded by spruce.

The bass tone bars 21 and treble tone bars 22 are typically strips of spruce. Although the tone bars are shown in a radial pattern in FIG. 1, any suitable pattern may be used.

The rib 26 is preferably made from a single piece of a "tone wood", which is a category of hard woods that are commonly used for musical instruments. The tone woods include maple, mahogany, and rosewood. The rib 26 allows for acoustic energy to couple efficiently between the top and back plates of the guitar 20. Note that if the top and back plates were completely flat, then the unfolded rib would be completely rectangular in profile. But because the top and back plates have their own curvatures and because the edges of the top and back plates are not constrained to parallel planes, the rib 26 assumes the wiggly shape shown in FIG. 1. Furthermore, the height of the rib 26 varies at different locations along the perimeter of the guitar 20. Note that the rib may be constructed in a piecewise fashion in sections that are joined during construction of the instrument. Note that although the word rib is used in a singular fashion to include the combination of a left rib and a right rib. The left rib and right rib may be manufactured from discrete pieces.

The longitudinal brace 25 may be referred to as a spine, and preferably runs from the neck end to the lower end of the back plate 25. It, too, is formed preferably as a laminate with an ebony core surrounded by spruce. The mass of the longitudinal brace 25 preferably is substantial compared to that of the back plate 27, so that a substantial portion of the mass of the back structure is located along its spine, in the middle of the back plate, parallel to the strings. Preferably, the longitudinal brace 25 accounts for approximately 15-20% of the combined weight of the back plate 27 and the longitudinal brace 25. However, instruments may be made in which the longitudinal brace 25 accounts for somewhat less, somewhat more, or even considerably more of the combined weight of the back plate 27 and the longitudinal brace 25. Percentages of as much as 30-35% or even more may be used in some types of instruments. The longitudinal brace 25 is attached to the upper surface of the back plate 27 with an epoxy, glue, or other suitable adhesive.

The back plate 27 itself is typically made from the same material as the rib, preferably one of the tone woods. Because the back plate 28 is supported by the longitudinal brace 25, it may be made uniformly thinner than is typical of the back plate in the common guitar, and the difference in mass may be shifted to the longitudinal brace 25, so that the mass is roughly the same between the back plate of the common guitar and the combination of the back plate 27 and the longitudinal brace 25 of the novel guitar 20. Keeping the mass roughly constant in this manner carries over some of the familiar acoustic properties of the common guitar to the current guitar 20. However, the combined mass of the combination of the back plate 27 and the longitudinal brace 25 may be varied from the mass of the back plate of the common guitar, if desired.

The novel back element, which is the back plate 27 with its attached longitudinal brace 25, has resonant patterns dramatically different from previous back plates, which enhance the tonal color and the projected sound level of the instrument.

Figure 2:
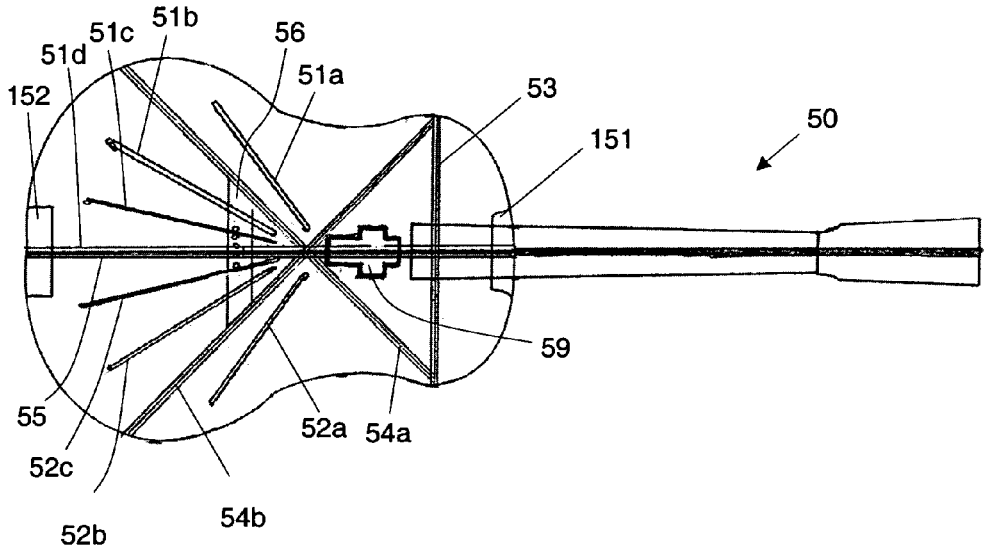
FIG. 2 is a top view of an acoustic guitar.
Figure 3:
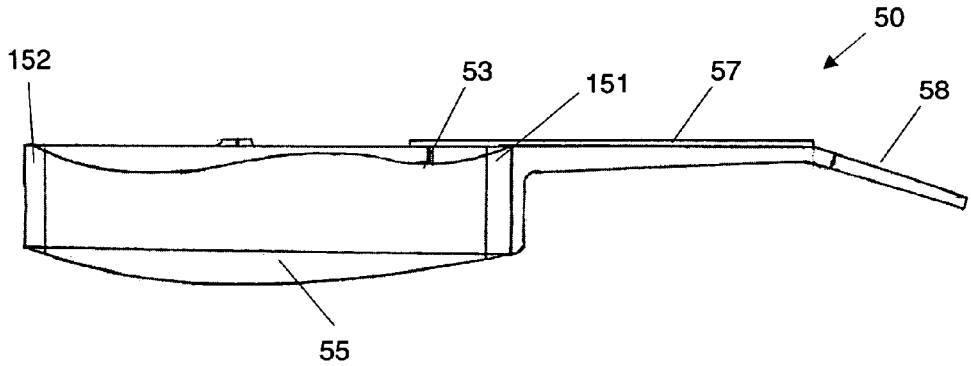
FIG. 3 is a right-side view of the acoustic guitar of FIG. 2.

FIGS. 2 and 3 show an assembled acoustic guitar 50. The bass tone bars 51 and treble tone bars 52 are attached to the underside of the top plate. The cross brace 54 and scalloped upper transverse brace 53 are also attached to the underside of the top plate. The longitudinal brace 55 is attached to the back plate. A bridge plate 56 attaches the strings to the top plate of the guitar 50. The top plate has a sound hole 59, which is not shown in FIG. 1. Likewise, FIGS. 2 and 3 show the neck 57 of the guitar 50, with the head stock 58. Illustratively, the neck 57 and head stock 58 form an angle of about 16.8°.

There is a neck block 151 and a bottom block or lower block 152, both preferably made of spruce, with the grain extending from the top plate to the back plate. The two blocks, not shown in the exploded view of FIG. 1, are common to the stringed instruments described herein, and play a largely structural role in the instruments. Typically, the neck connects to the body of the instrument at the neck block, which provides more support than if the neck were connected directly to the rib or to either plate. The lower block also provides support to the plates, and helps to relieve some of the tension on the top plate caused by the strings. Both blocks are typically glued to both plates and to the rib. Preferably, both blocks are notched to receive the longitudinal brace, which extends into them and is glued there as well.

Figure 4:
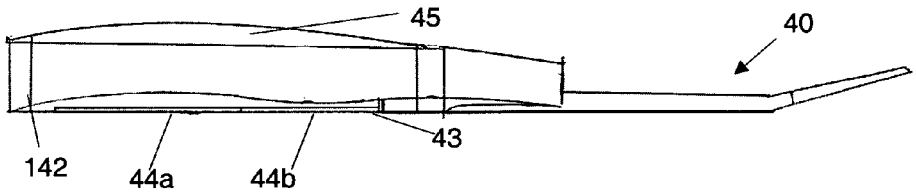
FIG. 4 is a left-side view of a cutaway acoustic guitar.
Figure 5:
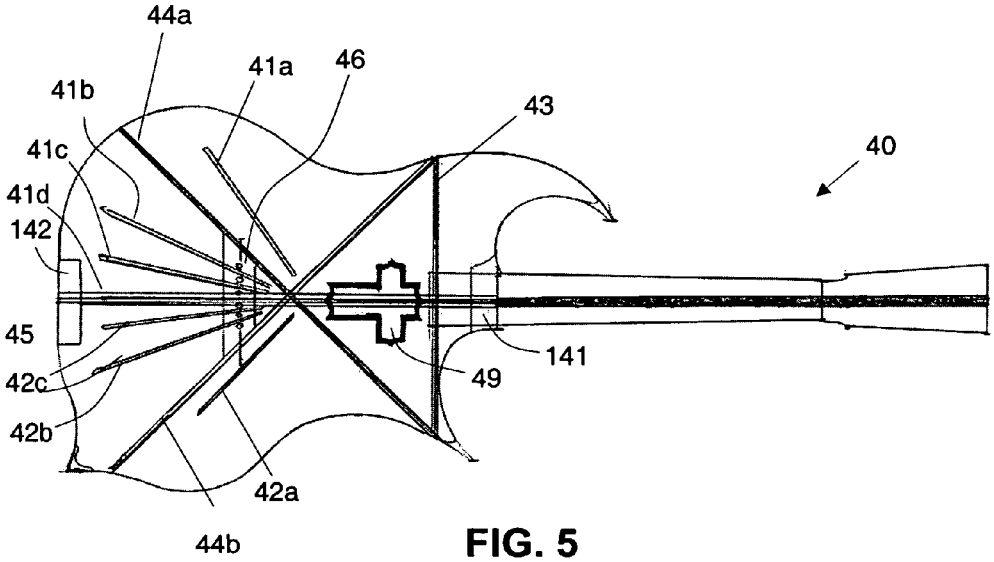
FIG. 5 is a top view drawing of the cutaway acoustic guitar of FIG. 4.
Figure 6:
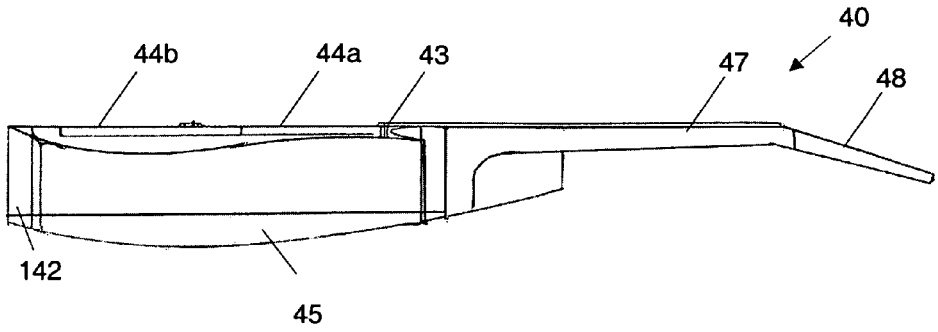
FIG. 6 is a right-side view of the cutaway acoustic guitar of FIGS. 4 and 5.

FIGS. 4-6 show different views of a cutaway guitar 40, named for the asymmetry of its body. Compared to the symmetric acoustic guitar 50 of FIGS. 2 and 3, the cutaway guitar 40 has a similar interior volume, but with an upper portion near the neck moved from one half to the other. Many of the other elements of the cutaway guitar 40 are similar to that of the acoustic guitar 50, including bass tone bars 41, treble tone bars 42, an upper transverse brace 43, a cross brace 44, a longitudinal brace 45, a bridge plate 46, a sound hole 49, a neck block 141 and a lower block 142. Illustratively, the neck 47 and head stock 48 are connected with an angle of about 18°.

Note that the two halves of the cutaway guitar 40 differ both in volume and in mass. However, advantageously the halves are tuned to respective tones of the diatonic scale. Just the right material is "removed" from one half and added to the other so that the resonance of the smaller half is preferably a third or fifth above the resonance of the larger half. This difference between the halves of the cutaway guitar 40 produces harmonics that tend to be further separated than the harmonics produced by a comparable symmetric guitar such as the acoustic guitar 50. This relatively large spectral separation between the harmonics and their fundamentals is nonetheless pleasing to the ear, and gives the cutaway guitar a different but no less rich tone.

FIG. 7 shows an exploded view of a violin 1. The violin 1 has many similarities to the guitar 20 of FIG. 1. The top plate 2, rib 6, longitudinal brace 15, and back plate 7 are similar in construction to the corresponding elements in the guitar 20, illustratively using identical materials and having generally the same function. As with the guitar, the top and back plates have a generally cylindrical curvature, with the cylindrical axis of one perpendicular to the cylindrical axis of the other. For the top plate 2, the cylindrical axis 5 is parallel to the strings, and for the back plate 7, the cylindrical axis 8 is perpendicular to the strings.

Several differences are seen in the form of the braces on the top plate, which provide structural support for the top plate, and the tone bars, which affect the tone of the instrument and do not play a structural role. The violin 1 has an upper transverse brace 13, similar in function and construction to the upper transverse brace 23 in the guitar 20. The upper transverse brace 13 is scalloped on the surface in contact with the top plate 2, leaving several substantial air gaps along the glue line, so that acoustic energy may pass more freely past the brace. The upper transverse brace 13 is mounted closer to the neck end 3 than the lower end 4. The violin 1 has a lower transverse brace 14, also scalloped, and similar in construction and function to the upper transverse brace 13, but located closer to the lower end 4 than the neck end 3. Note that the violin 1 uses two transverse braces on the top plate, in contrast with the guitar, which uses a transverse brace and a cross brace. All of the braces on the top plate for all the instruments herein use a laminated structure for the braces, with a high-density ebony core surrounded by spruce.

In contrast with the multiple tone bars used in the guitar 20, the violin 1 typically uses only a single bass tone bar 11, typically made of spruce. Note than the bass tone bar 11 may extend through the scallops in the transverse braces and therefore, may provide greater control over the acoustic properties than if unscalloped braces were used.

Figure 8:
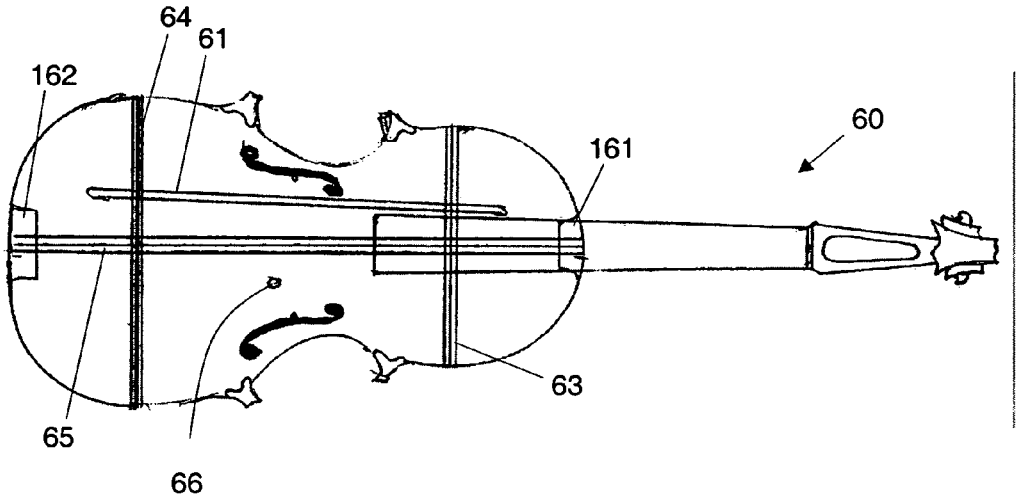
FIG. 8 is a top view drawing of a violin.
Figure 9:
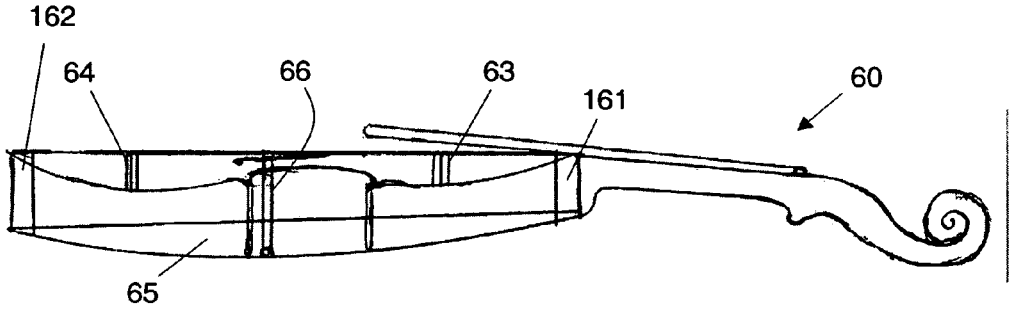
FIG. 9 is a right-side view drawing of the violin of FIG. 8.

FIGS. 8 and 9 show an assembled violin 60. The bass tone bar 61, upper transverse brace 63, lower transverse brace 64, and longitudinal brace 65 are all shown, and correspond to similar elements in FIG. 7. Unlike the guitar, the violin 60 has a sound post 66, typically made of spruce, which connects the top plate directly to the back plate, and is not shown in the exploded view of FIG. 7. The grain in the sound post 66 preferably extends from the front plate to the back plate. In contrast with the guitar, the top plate of the violin 60 uses two off-center "f-holes" rather than a single centered sound hole, as commonly seen in the guitar. The violin also has a neck block 161 and a lower block 162, which are not shown in FIG. 7.

Figure 10:
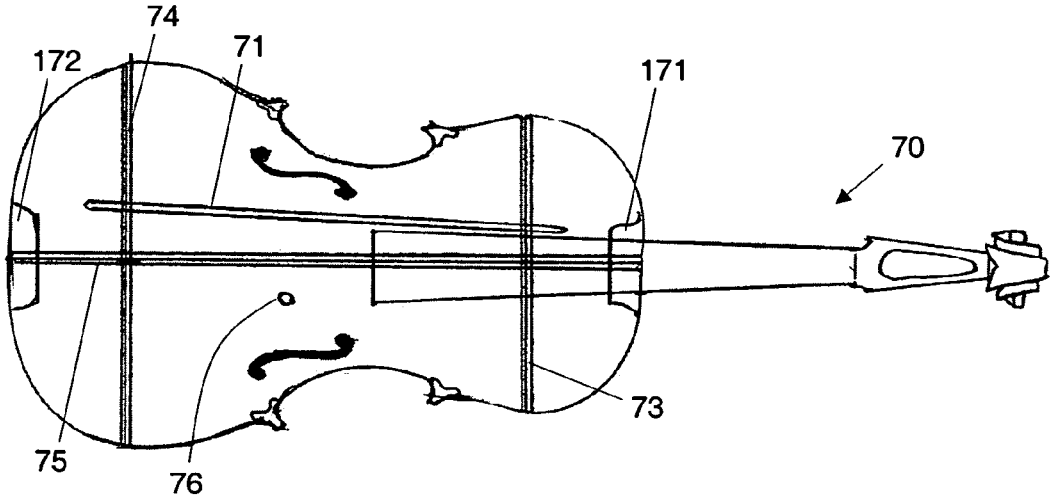
FIG. 10 is a top view drawing of a viola.
Figure 11:
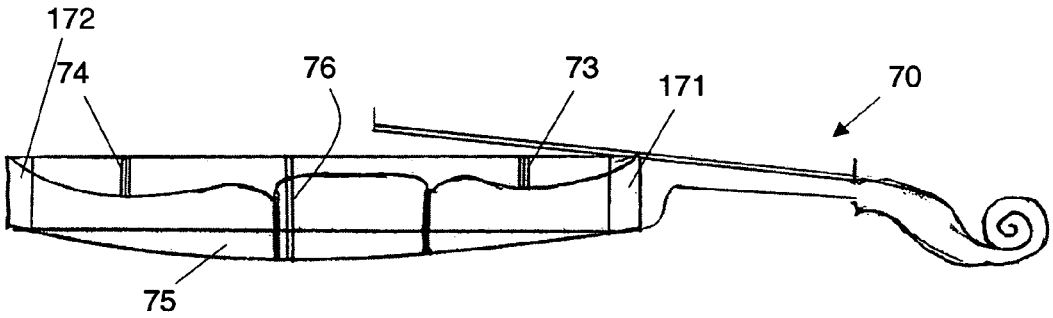
FIG. 11 is a right-side view drawing of the viola of FIG. 10.

FIGS. 10 and 11 show a viola 70. The viola 70 is larger than the violin 60 and has a deeper sound, but has a similar construction to the violin 60. The viola 70 also has a bass tone bar 71, upper transverse brace 73, lower transverse brace 74, longitudinal brace 75, sound post 76, neck block 171 and lower block 172. The materials and functions of these elements are essentially the same as the elements of the violin 60, but are all sized to accommodate the deeper sound of the instrument.

Figure 12:
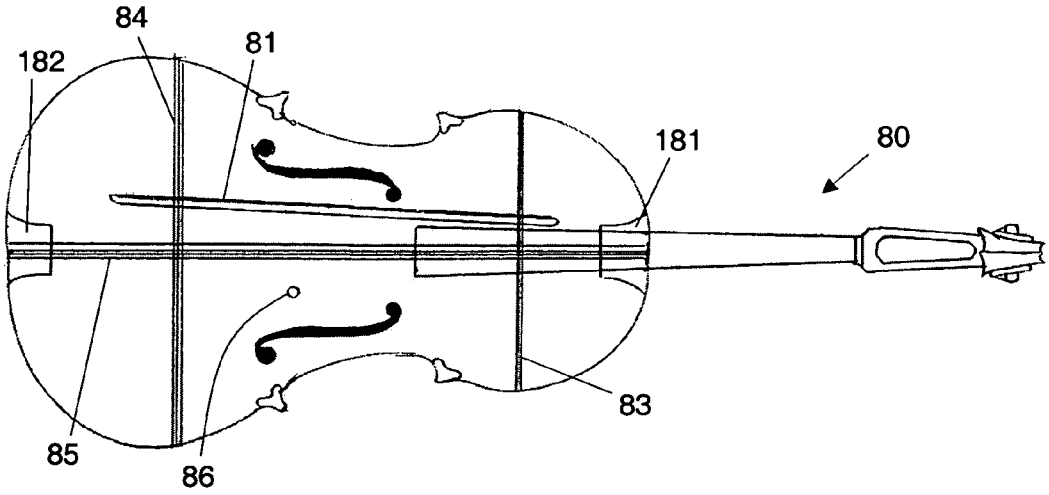
FIG. 12 is a top view drawing of a violincello.
Figure 13:
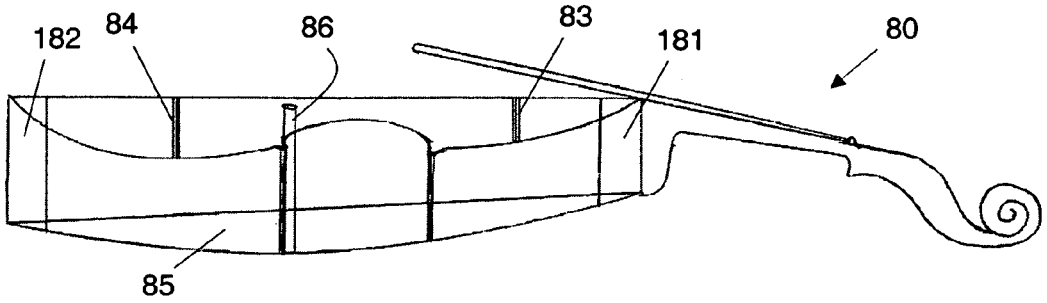
FIG. 13 is a right-side view drawing of the violincello of FIG. 12.

Even larger is the violincello 80, shown in FIGS. 12 and 13. It, too, has a bass tone bar 81, upper transverse brace 83, lower transverse brace 84, longitudinal brace 85, sound post 86, neck block 181 and lower block 182, with materials and functions are all essentially the same as the elements of the violin 60.

Figure 14:
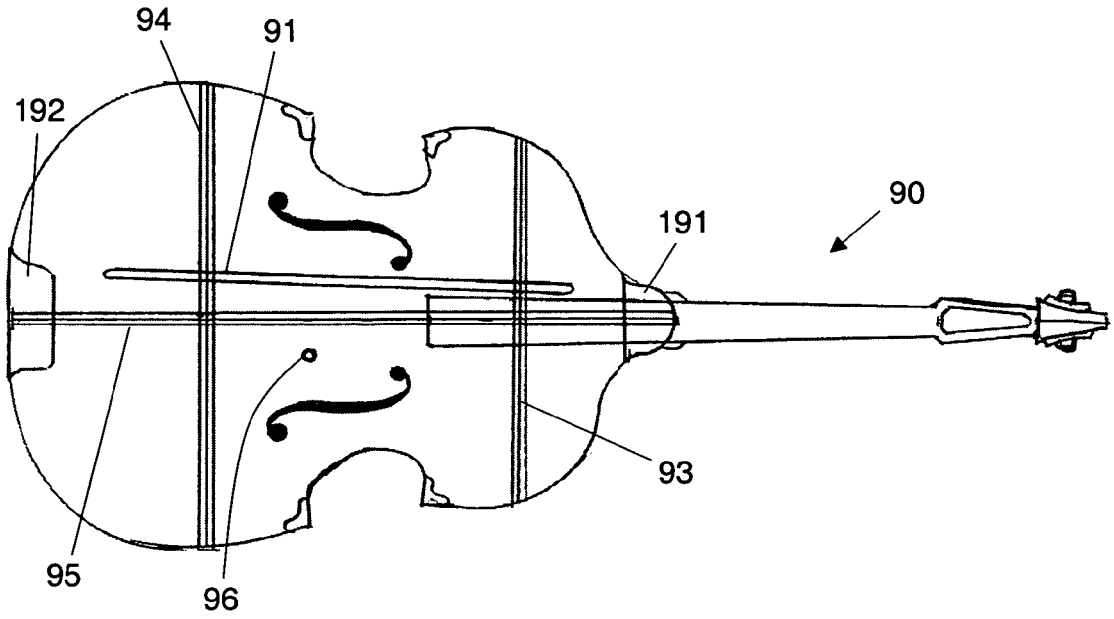
FIG. 14 is a top view drawing of a double bass violin/viol.
Figure 15:
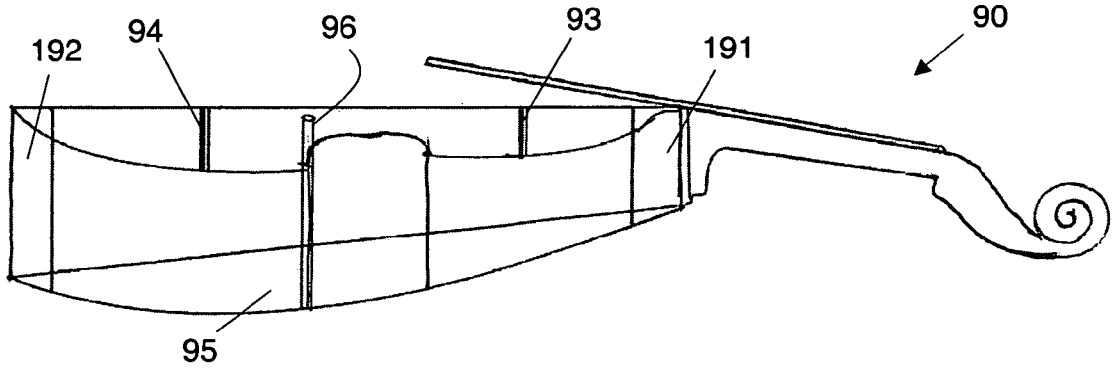
FIG. 15 is a right-side view drawing of the double bass violin/viol of FIG. 14.

Even larger than the violincello 80 is the double bass violin/viol 90, shown in FIGS. 14 and 15. It, too, has a bass tone bar 91, upper transverse brace 93, lower transverse brace 94, longitudinal brace 95, sound post 96, neck block 191 and lower block 192, with materials and functions are all essentially the same as the elements of the violin 60.

Figure 16:
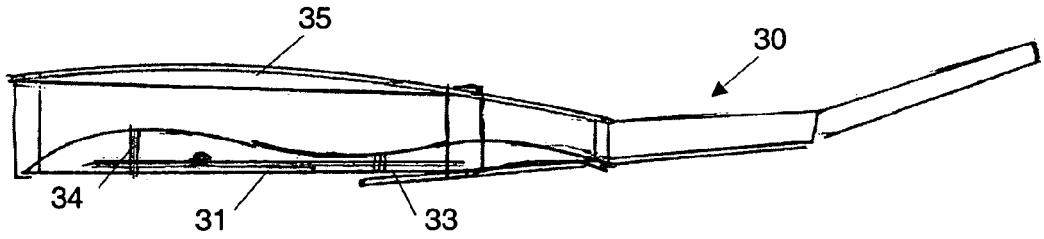
FIG. 16 is a left-side view drawing of a mandolin.
Figure 17:
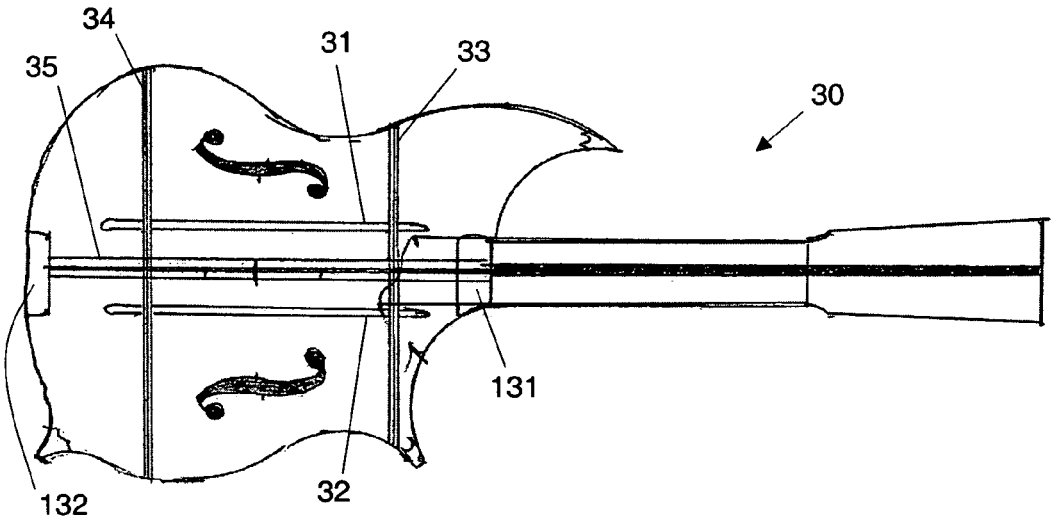
FIG. 17 is a top view drawing of the mandolin of FIG. 16.
Figure 18:
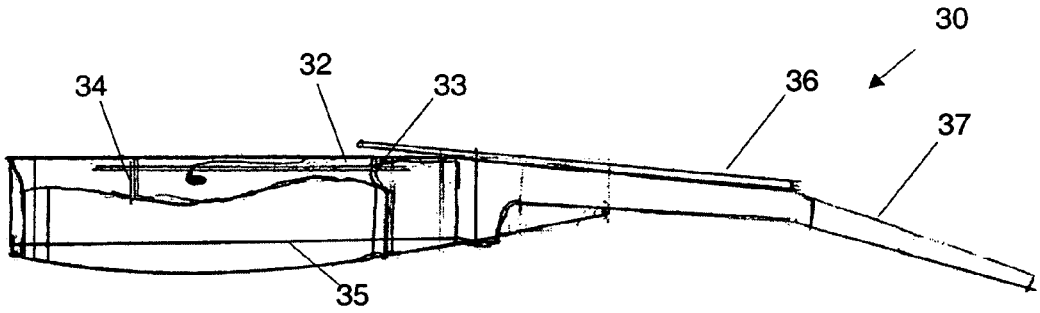
FIG. 18 is a right-side view drawing of the mandolin of FIGS. 16 and 17.

A mandolin 30 is shown in FIGS. 16-18. Like the cutaway guitar 40 of FIG. 4, the body of the mandolin 30 is asymmetric, as if a portion of the body adjacent to the neck 36 were moved from one half to the other. The mandolin 30 is shown with a single bass tone bar 31 and a single treble tone bar 32, both preferably made of spruce, although any suitable tone bar configuration may be used. The upper transverse brace 33 and lower transverse brace 34 are scalloped, similar to those in the violin 1. The longitudinal brace 35, along with the two transverse braces, preferably uses a laminated structure, with an ebony core surrounded by spruce. There is a neck block 131 and a lower block 132. Illustratively, the neck 36 is connected to the body at an angle of about 5°, and the head stock 37 and the neck are connected at an angle of about 13.5°.

I believe that the elements described herein produce a richer set of harmonics, and therefore produce a fuller, more pleasing tone in the instrument. Most of these harmonics are produced by the strings themselves, and are amplified by resonant regions of the instrument. I believe that the elements described herein create many more such resonant regions that found in known instruments. It should be noted that if a string vibrated only with a single frequency, then the output from the instrument would be only the single frequency.

One way to think about the resonant patterns of the instrument bodies is in terms of a known technique in which a test station is used to excite the instrument body with a sine wave tone at a particular frequency, and examine the response of the instrument body. The portions of the instrument body that do not oscillate form a "node", and the nodal patterns at particular frequencies provide information about the overall response of the instrument to particular frequencies. In general, because any stringed instrument has a rather complex shape, the instrument will have a large number of natural resonances arising from multiple surfaces and a cavity between them, starting from about 100 Hz for a guitar, up well past 1 KHz. These natural resonances have a wide variety of locations (i.e., resonant frequencies) and intensities (i.e., how strong a resonance it is).

Concentrating a substantial portion of the mass of the back plate to its spine has a significant impact on the natural resonances. In the common style of instrument in which the back plate may have a reinforced joint but does not have a spine, the back plate and the rib play a structural role, supporting the top plate. One might think of the rib as an "anchor", with little oscillation occurring at the outer perimeter of the instrument. In contrast, the back plate described herein has a substantial portion of its mass located at the spine. Here, the spine acts as an "anchor" for the rest of the instrument, with numerous oscillations occurring throughout the rest of the instrument. These new oscillation patterns are different in character from the well-known oscillation patterns. A larger oscillation at the rib itself may produce more oscillation of the outer body of the instrument, leading to more sound given off by the instrument body in all directions, leading finally to a more omnidirectional sound produced by the instrument. In particular, if the harmonics produced by a particular note give more oscillation at the outer instrument body, then the harmonics will be heard more loudly in all directions from the instrument. In general, this is a good thing, and gives a more complex, pleasing tone to the instrument.

Another aspect of the instruments described herein contributes both to their harmonic production as well as their omnidirectionality. I believe that in general, two similar but not identical structures in proximity are useful for producing rich harmonics. As an example, consider a concert hall with fine acoustics. Standing on the stage are a pair of excellent musicians, each playing the same piece on a high-quality guitar of the common type. As the musicians play, the sounds from one guitar produce harmonics in the other guitar, and vice versa. A listener in the audience perceives a richness in the sound that is normally not present from one guitar alone. The guitars, as carefully as they may be constructed and tuned, still have finite differences between them, be it in material thickness or spacing, or variations in density, and so forth. I believe that this subtle difference between the instruments contributes to the overall richness in tone produced by the combination of guitars, which one does not hear from a single guitar of the common type, regardless of how carefully the common guitar is crafted.

The harmonics produced by the two guitars on stage are heard differently in the audience, depending on where the listener is seated. There is a spatial dependence to the harmonics, meaning that there may be seats where the full harmonics are heard clearly, and there may be other seats where the harmonics are less clearly heard. This variation from seat-to-seat is undesirable. Furthermore, it is found that if the two musicians move farther apart on the stage, then there is more spatial dependence to the harmonics, or more seat-to-seat variation in how the harmonics are perceived. One finds that the amount of (undesirable) spatial dependence of the harmonics is inversely proportional to the distance between the two structures that created them.

The quality of rich harmonics that are produced by the pair of common-type instruments may be produced by a single instrument that has a substantial longitudinal brace bisecting the back plate. In essence, the brace separates the back plate inside the instrument into two structures, which are very close in properties such as volume and resonances, but which are not quite identical as a practical matter. Alternatively, the structures may be related along the diatonic scale, as by thirds or fifths. These two similar structures inside the instrument combine to produce a rich set of harmonics—the same quality of harmonics heard from two common-type instruments, but produced from a single instrument. A listener seated in the audience will hear these rich harmonics, and may think that it is coming from a pair of instruments. This is a substantial advantage of the instruments discussed herein over common instruments.

Furthermore, the rich harmonics produced by the single instrument have very little spatial dependence. The two structures are directly adjacent to each other, separated only by the thickness of the longitudinal brace. Because the two structures are so close, the spatial variation of the produced harmonics is extremely small. In other words, there is hardly any seat-to-seat variation of the harmonics, which sound essentially the same regardless of where the listener is sitting. This lack of spatial variation of the produced harmonics may be referred to as "filling the room". Because the harmonics from the instruments discussed herein adequately fill the room, the instruments may even overcome the inadequacies of a poorly designed concert hall. This, too, is a substantial advantage of the instruments discussed herein.

The tonal performance of certain stringed musical instruments may be strengthened and contoured by the use of one or more harmonic bridges in additional to a primary bridge. Various materials are suitable for bridges. Bridges may be made of a single flattened piece of wood as is common in the violin, or may be made of wood in combination with another material as is common in the guitar bridge, which usually includes a saddle as well as string anchor sites. Alternatively, a bridge may be made of a multiplicity of individual bridge elements in any combination, such as one for each string, one for each pair of strings, one for different number of strings, and so forth. A bridge may be mounted to a soundboard merely by resting on the soundboard in compression between the strings and the soundboard, but may be affixed, glued, screwed or otherwise mounted if desired. A bridge transmits the vibration of the strings travels to the soundboard.

The primary bridge is positioned to establish the scale length "S" of each of the strings between the saddle and the nut of the fingerboard. Each playing string is supported with suitable tension so as to control its speed of vibration over its scale length and establish the primary playing scale of the instrument. It will be appreciated that the respective segments S of the various strings may be of the same or different lengths.

One or more harmonic bridges are positioned to establish one or more harmonic segments. Where a single harmonic bridge is used, for example, respective harmonic segments "H1" and "H2" may be established, with segment H1 being between the primary bridge and the harmonic bridge, and with segment H2 being between the harmonic bridge and the acoustic termination of the string, which may be at a saddle, an point of the string, or other suitable termination. Each playing string is suitably tensioned so as to control its speed of vibration over its segments S, H1 and H2 for establishing the scale note and a second and a third harmonic response, which preferably are different but which may be the same if desired. It will be appreciated that the respective segments H1 and H2 of the various strings may be of the same or different lengths.

If desired, additional harmonic bridges may be used to establish additional harmonic segments. Two harmonic bridges, for example, may be used to establish three harmonic segments in addition to the scale segment for each string.

The use of one or more harmonic bridges in addition to the primary bridge is suitable for instruments having a soundboard and/or closedbox body that are designed to minimize wolf tones, and that have sufficient plate strength to support both bridges. When both bridges are affixed in the correct position on, for example, an instrument having a cylindrically curved top plate as described herein, the cylindrical top contour is strengthened, the bridge pressure is displaced over a greater area, and a coupling of vibration from the scale segment into a controlled harmonic cycling in the harmonic segments is achieved. When one or more scalloped top braces and one or more tone bars are used, a greatly improved transfer of bridge performance is realized by the tone bar cantilever effect across the laminated scalloped top brace.

Guitars such as those described herein that are designed for reduced wolf tones may incorporate one or more harmonic bridges without concern that wolf tones will be excited. In such instruments, the placement of the frets may be guided by harmonic considerations, an example of which is set forth below in Table 2. Note, for example, that the first harmonic of A 440 hertz is 879.99792 hertz, which is very near the proper harmonic of 880 hertz.

TABLE 2

| | | | | | |
|---|---|---|---|---|---|
| A | 440 | | | | |
| $B^b$ | 466.16367 | D | 587.32896 | $F^\#$ | 739.98752 |
| B | 493.88311 | $D^\#$ | 622.25322 | G | 783.98932 |
| C | 523.25082 | E | 659.25420 | $G^\#$ | 830.60759 |
| $C^\#$ | 554.36482 | F | 698.45535 | A | 879.99792 |

A suitable placement of frets to obtain the frequencies set forth in Table 2 for a segment A having a scale length between saddle and nut of 792.2 cm is set forth below in Table 3.

TABLE 3

| | |
|---|---|
| | 792.5 |
| 1st | 748.02001 |
| 2nd | 706.03652 |
| 3rd | 666.40939 |
| 4th | 629.00639 |
| 5th | 593.70267 |
| 6th | 560.38042 |
| 7th | 528.92842 |
| 8th | 499.24170 |
| 9th | 471.22117 |
| 10th | 444.77333 |
| 11th | 419.80991 |
| 12th | 396.24759 |

Figure 19:
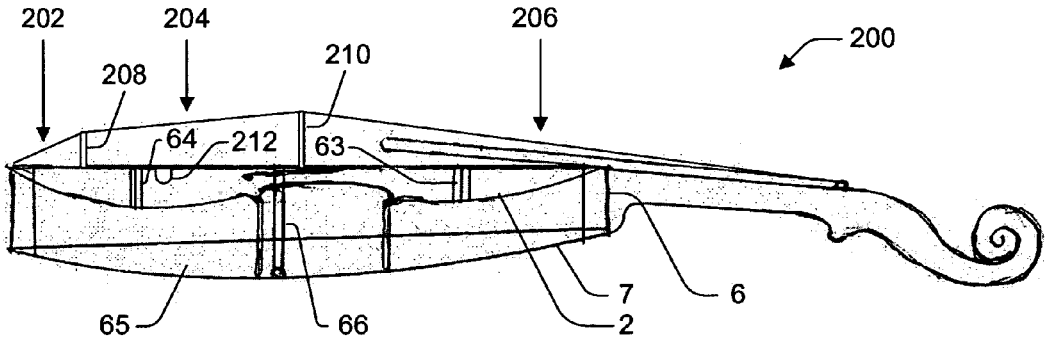
FIG. 19 is a right-side view drawing of a violin having an harmonic bridge in addition to a primary bridge.
Figure 20:
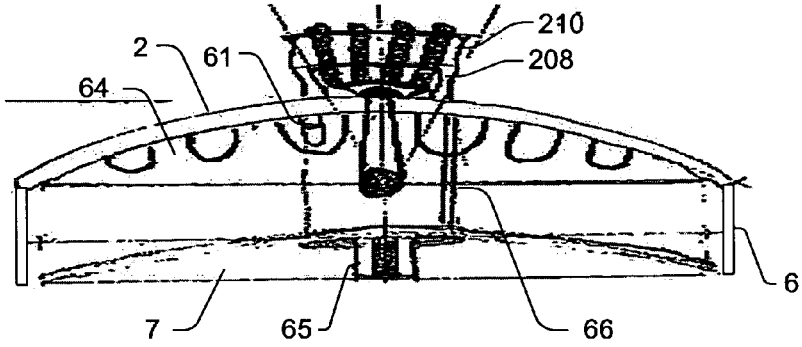
FIG. 20 is a bottom view drawing of the violin of FIG. 19.

An exemplary violin 200 having an harmonic bridge in addition to a primary bridge is shown in the right-side view drawing of FIG. 19 and the bottom view drawing of FIG. 20. The violin 200 has many of the same components as the violin 1 (FIG. 7) and the violin 60 (FIGS. 8 and 9), including the top plate 2, the rib 6, the longitudinal brace 15, the back plate 7, the upper transverse brace 63, the lower transverse brace 64, the bass tone bar 61 which extends through the scallops in the transverse braces 63 and 64, the longitudinal brace 65, and the sound post 66. The top and back plates have a very nearly equal mass and a generally cylindrical curvature, with the cylindrical axis of one perpendicular to the cylindrical axis of the other. For the top plate 2, the cylindrical axis is parallel to the strings, and for the back plate 7, the cylindrical axis is perpendicular to the strings. In addition, the violin 200 has a primary bridge 210 and a harmonic bridge 208, which establish scale segment 206 and harmonic segments 202 and 204. A second sound hole 212 is provided in the top plate 2, near the harmonic bridge 208.

Figure 21:
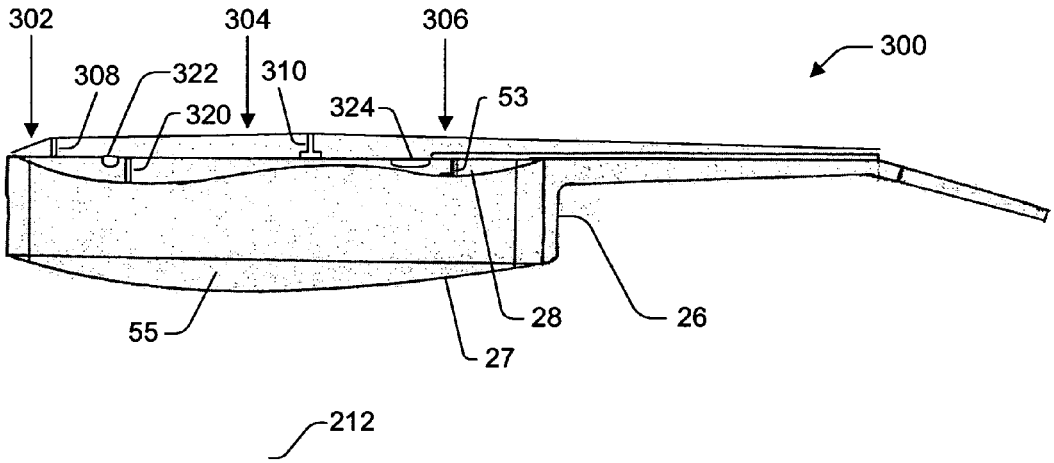
FIG. 21 is a right-side view drawing of a guitar having an harmonic bridge in addition to a primary bridge.
Figure 22:
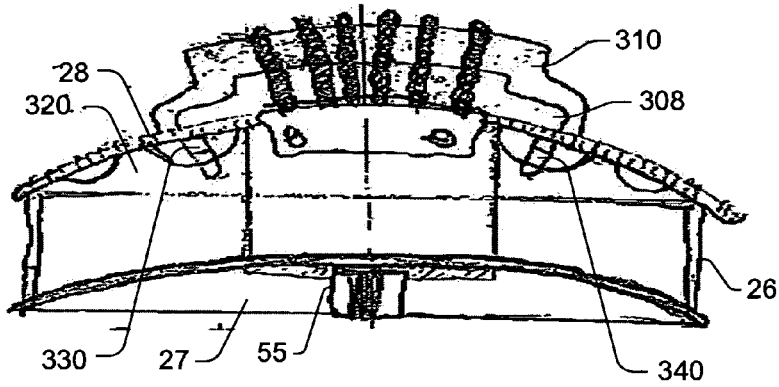
FIG. 22 is a bottom view drawing of the guitar of FIG. 21.

An exemplary guitar 300 having an harmonic bridge in addition to a primary bridge is shown in the right-side view drawing of FIG. 21 and the bottom view drawing of FIG. 22. The guitar 300 has many of the same components as the guitar 20 (FIG. 1) and the guitar 50 (FIGS. 2 and 3), including the top plate 28, the rib 26, the longitudinal brace 25, the back plate 27, the upper scalloped transverse brace 53, innermost bass tone bar 330 (for other bass tone bars see 51 in FIG. 1), and innermost treble tone bar 340 (for other treble tone bars see 52 in FIG. 1). The guitar 300 also includes a lower scalloped transverse brace 320 in lieu of the cross brace 54 of the guitar 20 (FIG. 1), with the base tone bar 330 and the treble tone bar 340 passing through scallops in the transverse brace 320. The top and back plates have very nearly equal mass and a generally cylindrical curvature, with the cylindrical axis of one perpendicular to the cylindrical axis of the other. For the top plate 28, the cylindrical axis is parallel to the strings, and for the back plate 27, the cylindrical axis is perpendicular to the strings. In addition, the guitar 300 has a primary bridge 310 and a harmonic bridge 308, which establish scale segment 306 and harmonic segments 302 and 304. A second sound hole 322 is provided in the top plate 28 near the harmonic bridge 308, along with sound hole 324.

Figure 23:
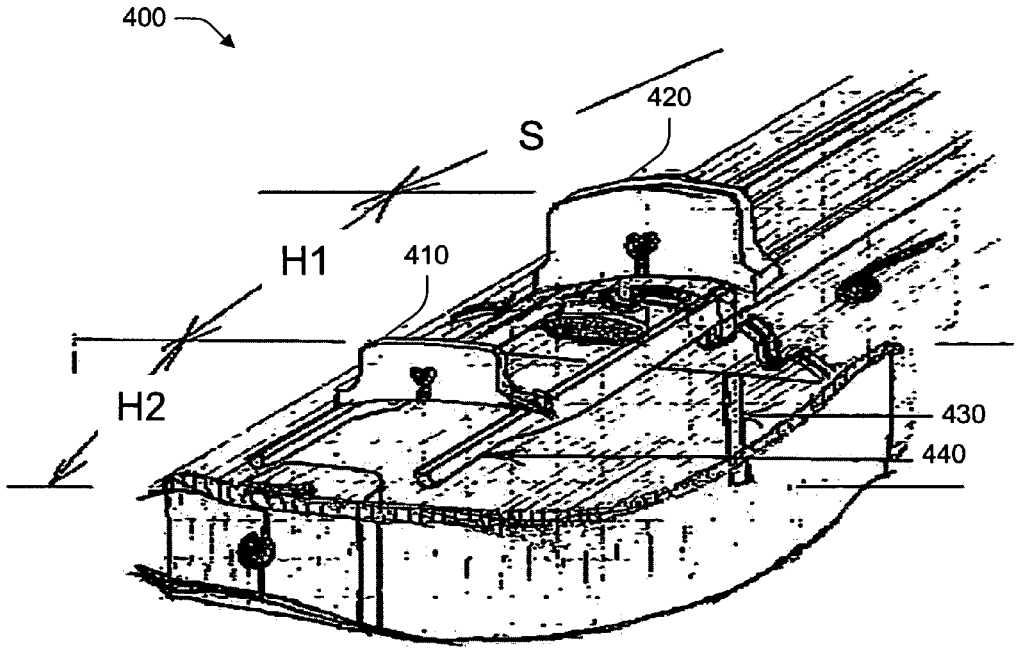
FIG. 23 is a perspective view drawing of a stringed instrument representative of either the violin of FIGS. 19 and 20, or the guitar of FIGS. 21 and 22.

FIG. 23 is a perspective view of a stringed closedbox instrument 400 that may be thought of as representative of the violin 200 if a sound post 430 is included instead of a treble tone bar 440, and representative of the guitar 300 if the treble tone bar 440 is included instead of the sound post 430. A primary bridge 420 and a harmonic bridge 410 are shown.

While different harmonic intonations are preferred when a harmonic bridge is used, the harmonic bridge may be located midway between the saddle and the string anchor to establish identical intonation in both harmonic segments. Generally, the position of the harmonic bridge and the distance between the saddle and the acoustic termination of the strings may be varied to establish any harmonic intonation that pleases the musician. Similarly, multiple harmonic tone bars may be located on the top plate under the harmonic segment to provide for additional harmonic intonations, if desired.

Figure 24:
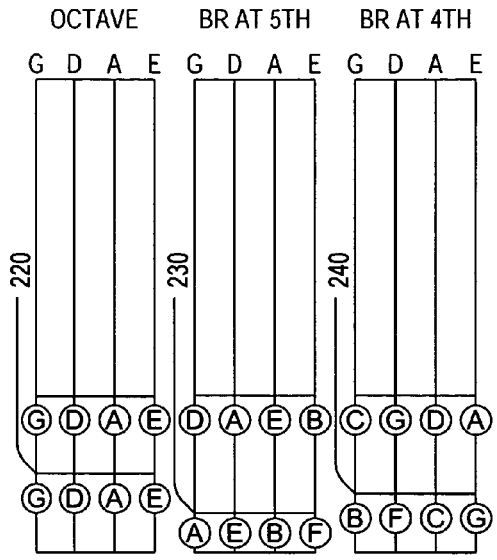
FIG. 24 is a graphical depiction showing various illustrative placements of a harmonic bridge and the possible intonations which are created thereby for a violin.
Figure 25:
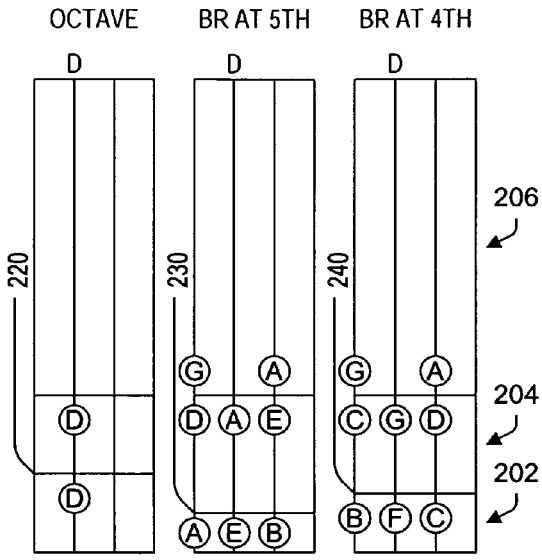
FIG. 25 is a graphical depiction showing the harmonics that result when a D is played for the various bridge placements shown in FIG. 24.

FIG. 24 shows for the violin 200 various illustrative placements of the harmonic bridge 208 and the possible intonations which are created. FIG. 25 shows the harmonics that result in the harmonic segments 202 and 204 and in the scale segment 206 when the D string is played on the scale segment 206, for the various bridge placements of FIG. 24. When the bridge 208 is placed at the octave position 220, for example, the harmonic segments 202 and 204 are of equal length and intonate an octave of the scale note. When the D string is played, the violin 200 plays DDD (FIG. 25). When the bridge 208 is placed at the fifth position 230, for example, the harmonic segment 204 intonates a fifth and the harmonic segment 202 intonates a second. When the D string is played, an A note sounds from the harmonic segment 204 and an E note sounds from the harmonic segment 202. These notes sympathetically couple to the A harmonic segment 202 of the adjacent G string and to the E harmonic segment 204 of the adjacent A string, which in turn intonate A, D and G, and E, B and A (FIG. 25). This results in the full note spectrum of chords GDA, DAE, and AEB being played, along with other harmonic varieties. When the bridge 208 is placed at the fourth position 240, for example, the harmonic segment 204 intonates a fourth and the harmonic segment 202 intonates a third. When the D string is played, a G note sounds from the harmonic segment 204 and a F note sounds from the harmonic segment 202. The G note sympathetically couples to the G scale segment 206 of the G string, which in turn intonates C and B on the harmonic segments 204 and 202 (FIG. 25). The C note on the harmonic segment 204 of the G string sympathetically couples to the C harmonic segment 202 of the A string, which in turn intonates D on the harmonic segment 204 and A on the scale segment 206. This results in the full note spectrum of chords GDA, CGD, and BFC being played, along with other harmonic varieties. An advantage of the fourth placement 240 of an harmonic bridge in an instrument such as the violin 200 which is tuned to the fifth ascending is that the violin may then have common harmonics with instruments tuned to the fourth ascending, such as the guitar. This allows for controlling harmonic exchange between instruments, and the intonation of the combined musical result.

Figure 26:
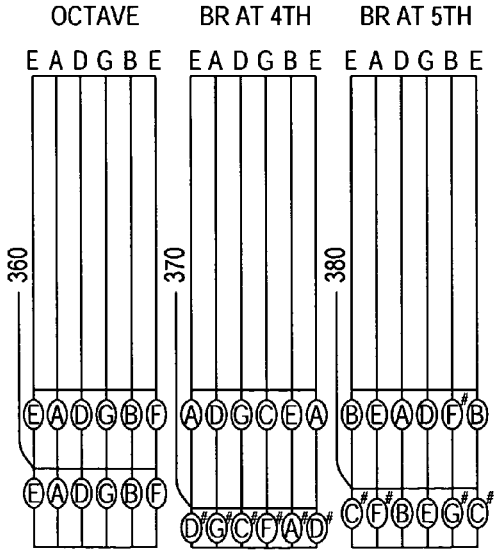
FIG. 26 is a graphical depiction showing various illustrative placements of a harmonic bridge and the possible intonations which are created thereby for a guitar.
Figure 27:
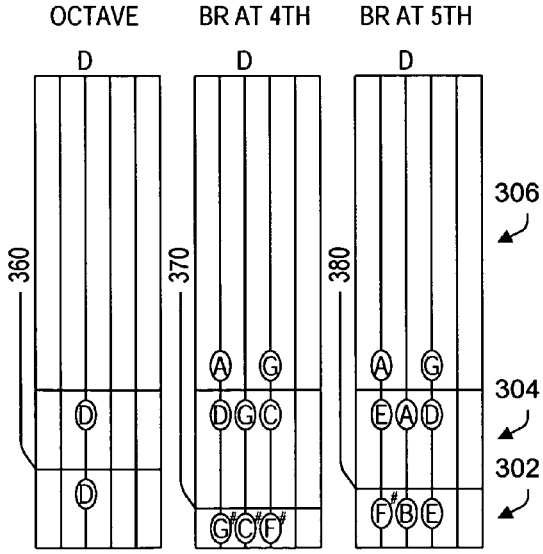
FIG. 27 is a graphical depiction showing the harmonics that result when a D is played for the various bridge placements shown in FIG. 26.

FIG. 26 shows for the guitar 300 various illustrative placements of the harmonic bridge 308 and the possible intonations which are created. FIG. 27 shows the harmonics that result in the harmonic segments 302 and 304 and in the scale segment 306 when the D string is played on the scale segment 306, for the various bridge placements of FIG. 26. When the bridge 308 is placed at the octave position 360, for example, the harmonic segments 302 and 304 are of equal length and intonate an octave of the scale note. When the D string is played, the guitar 300 plays DDD (FIG. 27). When the bridge 308 is placed at the fourth position 370, for example, the harmonic segment 304 intonates a fourth and the harmonic segment 302 intonates a seventh. When the D string is played, a G note sounds from the harmonic segment 304 and a C# note sounds from the harmonic segment 302. These notes sympathetically couple to the G# harmonic segment 302 of the adjacent A string and to the C harmonic segment 304 of the adjacent G string, which in turn intonate G#, D and A, and C, F# and G (FIG. 27). This results in the full note spectrum of chords ADG, DGC and G#C#F# being played, along with other harmonic varieties. When the bridge 308 is placed at the fifth position 380, for example, the harmonic segment 304 intonates a fifth and the harmonic segment 302 intonates a sixth. When the D string is played, an A note sounds from the harmonic segment 304 and a B note sounds from the harmonic segment 302. The A note sympathetically couples to the A scale segment 306 of the A string, which in turn intonates E and F# on the harmonic segments 304 and 302 (FIG. 27). The E note on the harmonic segment 304 of the A string sympathetically couples to the E harmonic segment 302 of the G string, which in turn intonates D on the harmonic segment 304 and G on the scale segment 306. This results in the full note spectrum of chords ADG, EAD, and F#BE being played, along with other harmonic varieties. An advantage of the fifth placement 380 of an harmonic bridge in an instrument such as the guitar 300 which is tuned to the fourth ascending is that the guitar may then have common harmonics with instruments tuned to the fifth ascending, such as the violin. This allows for controlling harmonic exchange between instruments, and the intonation of the combined musical result.

Although tuning of the stringed instruments in the examples described above is performed on open strings, it will be appreciated that the stringed instrument could be tuned in other ways, such as on chords. Although the open strings of the scale of the stringed instruments in the examples described above are provided between the primary bridge and the nut of the fingerboard, it will be appreciated that the scale segments may be provide in other places along the strings of the instrument, such as between two bridges.

It will be appreciated that the height or other properties of the harmonic bridge and the distance to the acoustic termination of the string may be adjusted for each string individually, to intonate in other combinations pleasing to the musician.

The description of the invention and its applications as set forth herein is illustrative and is not intended to limit the scope of the invention. Variations and modifications of the embodiments disclosed herein are possible, and practical alternatives to and equivalents of the various elements of the embodiments would be understood to those of ordinary skill in the art upon study of this patent document. These and other variations and modifications of the embodiments disclosed herein may be made without departing from the scope and spirit of the invention.

The invention claimed is:

1. A stringed musical instrument comprising:

a body comprising a soundboard having a generally cylindrical curvature with a crest being defined thereon;

a first bridge mounted to the soundboard across the crest of the soundboard;

a second bridge harmonically spaced away from the first bridge and mounted to the soundboard across the crest of the soundboard; and a plurality of strings extending across the first and second bridges between a first acoustic termination and a second acoustic termination; and a neck comprising a fingerboard playable to define play lengths of the strings, and a nut at the first acoustic termination to define scale lengths of the strings;

wherein each of the strings has a section defined by the harmonic spacing between the first and second bridges for sounding harmonically with the play lengths and the scale lengths thereof.

2. The stringed musical instrument of claim 1 wherein the soundboard comprises a top plate of a closedbox instrument, further comprising:

a back plate; and a rib coupling the top plate and the back plate to form an acoustic cavity.

3. The stringed musical instrument of claim 2 wherein the back plate has generally cylindrical curvature with a crest being defined thereon, the crest of the top plate being transverse to the crest of the back plate.

4. The stringed musical instrument of claim 3 wherein the acoustic cavity is vented.

5. The stringed musical instrument of claim 3 wherein the acoustic cavity is vented through a first sound hole disposed in the top plate proximate the first bridge, and through a second sound hole disposed in the top plate proximate the second bridge.

6. The stringed musical instrument of claim 1 further comprising:

a third bridge harmonically spaced away from the second bridge and mounted to the soundboard across the crest of the soundboard;

wherein the plurality of strings further extends across the third bridge between the first acoustic termination and the second acoustic termination; and wherein each of the strings has a second section defined by the harmonic spacing between the second and third bridges for sounding harmonically with the first section and the play lengths and the scale length thereof.

7. The stringed musical instrument of claim 1 wherein:

segments of the strings extending between the first acoustic termination and the first bridge establish an instrument scale;

segments of the strings extending between the first bridge and the second bridge establish a first harmonic scale.

8. The stringed musical instrument of claim 7 wherein segments of the strings extending between the second bridge and the second acoustic termination establish a second harmonic scale.

9. The stringed musical instrument of claim 1 wherein:

the first bridge comprises a generally planar acoustic member mounted upon and perpendicular to the crest of the soundboard; and the second bridge comprises a generally planar acoustic member mounted upon and perpendicular to the crest of the soundboard.

10. A stringed musical instrument comprising:

an acoustic body comprising:

a top plate having a curvature that defines a crest thereon;

a back plate; and a rib coupling the top plate and the back plate to form an acoustic cavity;

a first bridge mounted to the top plate across the crest of the top plate;

a second bridge harmonically spaced away from the first bridge and mounted to the top plate across the crest of the top plate; and a plurality of strings extending across the first and second bridges between a first acoustic termination and a second acoustic termination; and a neck comprising a fingerboard playable to define play lengths of the strings, and a nut at the first acoustic termination to define scale lengths of the strings;

wherein each of the strings has a section defined by the harmonic spacing between the first and second bridges for sounding harmonically with the play lengths and the scale lengths thereof.

11. The stringed musical instrument of claim 10 wherein the back plate has a curvature that defines a crest thereon, the crest of the back plate being transverse to the crest of the top plate.

12. The stringed musical instrument of claim 10 wherein the curvature of the top plate is cylindrical.

13. The stringed musical instrument of claim 11 wherein:

the curvature of the top plate is cylindrical;

the curvature of the back plate is cylindrical; and the crest of the back plate is perpendicular to the crest of the top plate.

14. The stringed musical instrument of claim 10 wherein the curvature of the top plate is conical.

15. The stringed musical instrument of claim 11 wherein:

the curvature of the top plate is conical;

the curvature of the back plate is conical; and the crest of the back plate is perpendicular to the crest of the top plate.

16. The stringed musical instrument of claim 10 wherein the curvature of the top plate is aspheric.

17. The stringed musical instrument of claim 11 wherein:

the curvature of the top plate is aspheric;

the curvature of the back plate is aspheric; and the crest of the back plate is perpendicular to the crest of the top plate.

18. The stringed musical instrument of claim 10 wherein:

the first bridge comprises a generally planar acoustic member mounted upon and perpendicular to the crest of the top plate;

the second bridge comprises a generally planar acoustic member mounted upon and perpendicular to the crest of the top plate; and the acoustic cavity is vented through a first sound hole disposed in the top plate proximate the first bridge, and through a second sound hole disposed in the top plate proximate the second bridge.

19. The stringed musical instrument of claim 10 wherein:

segments of the strings extending between the first acoustic termination and the first bridge establish an instrument scale;

segments of the strings extending between the first bridge and the second bridge establish a first harmonic scale; and segments of the strings extending between the second bridge and the second acoustic termination establish a second harmonic scale.

20. A stringed musical instrument comprising:

an acoustic body comprising:

a top plate having a cylindrical curvature with a crest being defined thereon on an outside convex surface;

a back plate having a cylindrical curvature with a crest being defined thereon, the crest of the top plate being perpendicular to the crest of the back plate; and a rib coupling the top plate and the back plate to form an acoustic cavity;

a first bridge comprising a generally planar acoustic member mounted upon the outside convex surface of the top plate perpendicular to the crest of the soundboard;

a second bridge harmonically spaced away from the first bridge, the second bridge comprising a generally planar acoustic member mounted upon the outside convex surface of the top plate perpendicular to the crest of the soundboard; and a fingerboard mounted to the acoustic body;

a plurality of strings extending across the fingerboard and the first and second bridges between a first acoustic termination near an end of the fingerboard distal of the acoustic body, and a second acoustic termination near an end of the acoustic body distal of the fingerboard;

wherein segments of the strings extending between the first acoustic termination and the first bridge establish an instrument scale, segments of the strings extending between the first bridge and the second bridge establish a first harmonic scale; and segments of the strings extending between the second bridge and the second acoustic termination establish a second harmonic scale.

* * * * *